US008692149B2

(12) United States Patent
Gentsch

(10) Patent No.: US 8,692,149 B2
(45) Date of Patent: Apr. 8, 2014

(54) LOW-VOLTAGE, MEDIUM-VOLTAGE OR HIGH-VOLTAGE SWITCHGEAR ASSEMBLY HAVING A SHORT-CIRCUITING SYSTEM

(75) Inventor: Dietmar Gentsch, Ratingen (DE)

(73) Assignee: ABB Technology AG, Zürich (CH)

( * ) Notice: Subject to any disclaimer, the term of this patent is extended or adjusted under 35 U.S.C. 154(b) by 381 days.

(21) Appl. No.: 12/718,202

(22) Filed: Mar. 5, 2010

(65) Prior Publication Data

US 2010/0219162 A1 Sep. 2, 2010

Related U.S. Application Data

(63) Continuation of application No. PCT/EP2008/007121, filed on Sep. 1, 2008.

(30) Foreign Application Priority Data

Sep. 5, 2007 (EP) ..... 07017360

(51) Int. Cl.
*H01H 39/00* (2006.01)
*H01H 33/66* (2006.01)

(52) U.S. Cl.
USPC ..... 218/121; 361/2; 361/42; 218/10

(58) Field of Classification Search
USPC ..... 218/7, 10, 118–126
See application file for complete search history.

(56) References Cited

U.S. PATENT DOCUMENTS

| | | | | |
|---|---|---|---|---|
| 3,548,135 | A * | 12/1970 | Wood | 218/123 |
| 4,224,487 | A | 9/1980 | Simonsen | |
| 6,839,209 | B2 * | 1/2005 | Shea et al. | 361/42 |
| 2003/0231443 | A1 | 12/2003 | Shea et al. | |

FOREIGN PATENT DOCUMENTS

| | | | |
|---|---|---|---|
| DE | 197 46 815 | A1 | 4/1999 |
| DE | 199 16 329 | A1 | 10/2000 |
| DE | 199 21 173 | A1 | 11/2000 |
| DE | 102 54 497 | B3 | 6/2004 |
| DE | 10254497 | * | 6/2004 |

OTHER PUBLICATIONS

International Preliminary Report on Patentability (Form PCT/IB/373) issued in PCT/EP2008/007121, Mar. 9, 2010, and accompanying Written Opinion (Form PCT/ISA/237), International Bureau of WIPO, Geneva, CH and European Patent Office, Munich, DE.

International Search Report for PCT/EP2008/007121 completed Nov. 17, 2008.

European Search Report for EP 07017360.4 completed Oct. 12, 2007.

Written Opinion for PCT/EP2008/007121 completed Nov. 17, 2008.

* cited by examiner

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

A switchgear assembly includes a vacuum interrupt chamber and a short-circuiting system arranged in the vacuum interrupt chamber. To enable rapid switching with physically simple means, a vacuum area of the vacuum interrupt chamber in which a fixed contact piece is placed is subdivided via a membrane, which is provided with a breaking line and which can be penetrated by a moving piston system to the contact piece during switching. The switchgear assembly can be utilized in a low-voltage, medium-voltage or high-voltage assembly.

15 Claims, 3 Drawing Sheets

LOW-VOLTAGE, MEDIUM-VOLTAGE OR HIGH-VOLTAGE SWITCHGEAR ASSEMBLY HAVING A SHORT-CIRCUITING SYSTEM

RELATED APPLICATIONS

This application claims priority as a continuation application under 35 U.S.C. §120 to PCT/EP2008/007121, which was filed as an International Application on Sep. 1, 2008 designating the U.S., and which claims priority to European Application 07017360.4 filed in Europe on Sep. 5, 2007. The entire contents of these applications are hereby incorporated by reference in their entireties.

FIELD

The present disclosure relates to a low-voltage, medium-voltage and high-voltage switchgear assembly having a short-circuiting system.

BACKGROUND INFORMATION

Low-voltage, medium-voltage and high-voltage switchgear assemblies have the task of distributing the energy flow and of ensuring safe operation. In the improbable case of an internal fault (fault arc), installation safety and personal safety must also be ensured. A fault arc which occurs within a switchgear assembly would produce a sharp pressure rise of the gas, due to the temperature of the gas, within a time period of a few milliseconds, which can lead to the switchgear assembly being destroyed by explosion. Measures are therefore adopted in order to dissipate the pressure as quickly as possible. Furthermore, an arcing fault is intended to be restricted to the relevant area, and must not endanger the operator.

The creation of fault arcs can be restricted by suitable design, such as by internal subdivision of the switch panel (compartmentalization), for example. For this purpose, the individual switch panels of a switchgear assembly can have pressure-relief openings or pressure-relief channels, via which the gas can flow out into the surrounding area. The effects of a fault arc can therefore be limited by reducing the arc duration.

This effect can be achieved with the aid of suitable sensors which react to light, temperature or pressure and which release the upstream circuit breaker, such as the feed switch. This arrangement results in arcing times of 40 ms to 80 ms (a fault arc which burns in a gas atmosphere air or in some other insulating gas within a subdivision, that is to say a compartment (encapsulation) or in a solid (boundary layer)). However, this arrangement has the disadvantage that the greatest mechanical load occurs just after approximately 10 ms, and only the thermal load is reduced. This arrangement involves a generally robust and costly configuration of the design of a switchgear assembly, of encapsulation or of a solid-insulated system.

In order to overcome an internal fault (fault arc) even while the pressure is rising, a switching device is a switching device is provided to switch within a few milliseconds. The inclusion of such a switching device is known as a so-called short-circuiting system. Exclusively three-phase short-circuiting devices such as these are known to switch in air or $SF_6$. In any case, the switching rating and isolation capability are reduced because of the high inrush current on repeated switching. In contrast, when using a vacuum interrupter chamber, these electrical characteristics remain virtually unchanged as the number of switching operations increases.

A range of solutions relating to this issue have been proposed in the prior art.

DE 199 21 173 A1 discloses a short-circuiting system which contains a vacuum interrupter chamber in each individual phase or between the phases, based on the principle of a "switched vacuum interrupter chamber" and "triggered vacuum gap".

DE 199 16 329 A1 discloses a short-circuiting device for a fault arc protection apparatus, for use in installations for distribution of electrical power with a gas generator and a short-circuiting piston, which is driven directly by the gas generator, for electrical connection of connecting rails to a connection rail which is intended to be compact, to have good piston guidance and to be suitable for use with gas generators. The piston guidance is achieved by the short-circuiting piston being guided and held in a connection rail. In addition, the gas generator is embedded in a holding part which has an initial volume, is composed of insulating material, and is directly attached to the connection rail.

DE 197 468 15 A1 discloses a similar fault-arc protection apparatus for use in installations for distribution of electrical power with a gas generator, in which the short-circuiting piston, which is driven by the gas generator, carries out an optimum sudden movement, and is at the same time secured for transportation, independently of manufacturing tolerances, with a further objective of the gas generator being securely mounted. This objective is achieved by the short-circuiting piston being provided with at least one O-ring as a seal. In addition, the upper face of the short-circuiting piston rests flush on a pressure membrane in the unreleased state, such that a vacuum would be created in the event of a piston movement in the unreleased state, and would move the short-circuiting piston back to its rest position.

However, there are drawbacks associated with the second and third cited prior art references for switchgear assemblies, including medium-voltage switchgear assemblies, for example. In conjunction with the upstream circuit breaker, known short-circuiting devices switch too slowly. Because of their three-phase design, they are generally also technically too complicated and costly. During a switching process, these short-circuiting devices connect the previously live current path in all three phases to ground, or else between the individual phases. This in turn involves a compact, complex ground current path for carrying the generally high fault current for a short time. Furthermore, the current results in a decrease in the switching rating and the isolation capability over the lifespan of the short-circuit devices.

SUMMARY

An exemplary embodiment provides a switchgear assembly which comprises a vacuum interrupt chamber, and at least one short-circuiting device arranged in the vacuum interrupt chamber. The at least one short-circuiting device includes a fixed contact piece arranged in a vacuum area of the vacuum interrupter chamber, a moving contact piece, and a unit for causing the moving contact piece to close onto the fixed contact piece. In addition, the at least one short-circuiting device includes a membrane sub-dividing the vacuum area in which the fixed contact piece is arranged. The membrane has a breaking line which is configured to be penetrated during a switching operation when the moving contact piece is moved through the membrane and closed onto the fixed contact piece.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
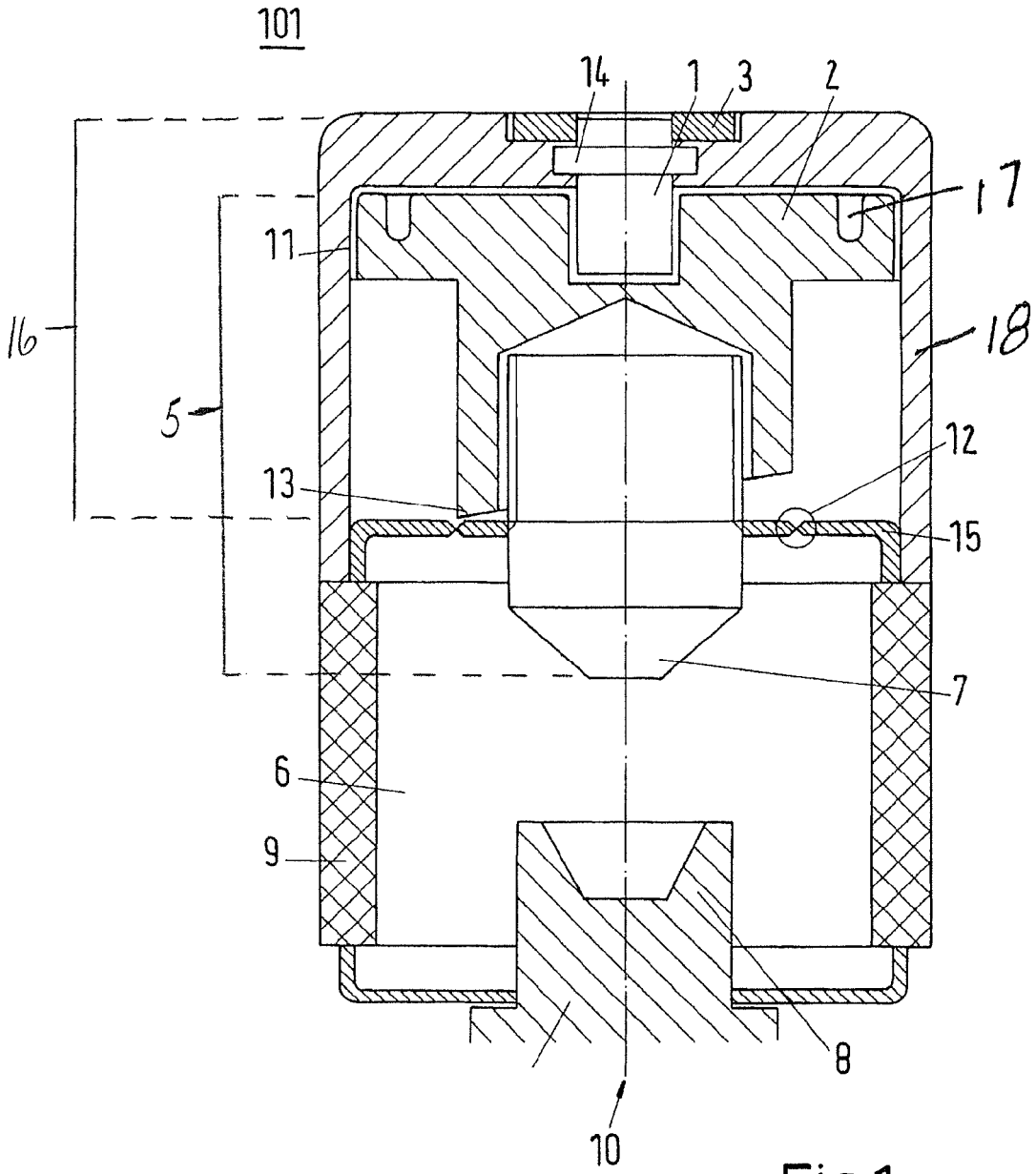
FIG. 1 shows an exemplary embodiment of a short-circuiting device according to the present disclosure.

Exemplary embodiments of the present disclosure provide a switchgear assembly having a short-circuiting device which overcomes the described disadvantages of the prior art, and allows rapid switching with physically simple means.

According to an exemplary embodiment of the present disclosure, a short-circuiting device is arranged in a vacuum interrupter chamber, and the vacuum area in which the fixed contact piece is placed is subdivided via a membrane which is provided with a weak breaking line. An appropriately designed piston above the moving contact piece (in the form of a plug or a socket, likewise arranged in the vacuum of the switching chamber) will penetrate the membranes in the area of the weak point during switching, moving the unit in the direction of the fixed contact. In consequence, there is no need at all for the bellows, which are normally otherwise required, on the moving contact. The penetration movement, which is now all that is needed, advantageously results in better dynamics and therefore in faster switching.

According to an exemplary embodiment, the moving contact is arranged at the tip of the moving contact piece which moves during switching is arranged, and in the unoperated state, passes through the membrane to form a vacuum-tight seal.

According to an exemplary embodiment, the moving contact piece can be screwed, welded and/or soldered to the membrane. The upper cylinder area is therefore bounded from the lower vacuum area in a vacuum-tight manner.

According to an exemplary embodiment, the moving contact piece is connected to a piston-cylinder arrangement which can be acted on by a gas generator. The piston-cylinder arrangement has a cutting edge, which passes through the weak point during operation. The cutting edge is arranged on the lower face of the piston, at the level shortly in front of the weak breaking line of the membrane. This exemplary arrangement can result in even better dynamics than gas-tight disconnection by means of an otherwise normal bellows.

According to an exemplary embodiment, the piston is composed of electrically conductive material and is configured to make an electrically conductive connection with the moving contact, and an annular sliding contact is arranged on the piston running surface. This exemplary arrangement results in the electrical contact effectively being driven with the moving contact piece in a simple manner.

According to an exemplary embodiment, the gas generator is in the form of a cartridge with a chemical propellant charge which can be inserted and secured via a screw connection which can be fitted at an appropriate point to the housing 16 of the switching chamber. The propellant charge can therefore be used subsequently or, if appropriate, can be replaced after a certain time. The screw connection also provides a form of mechanical overload protection.

According to an exemplary embodiment, the upper part of the short-circuiting device, which contains the piston-cylinder arrangement, can be composed of metallic material, and the lower part of the short-circuiting device can comprise a vacuum interrupter chamber which is composed of an insulator.

According to an exemplary embodiment, the vacuum interrupter chamber and/or a dielectric material of the vacuum interrupter chamber can be composed of a ceramic material.

According to an exemplary embodiment, the tip of the moving contact can be provided with an external cone, and the fixed contact is provided with an internal cone which is complementary to the external cone of the moving contact. This exemplary configuration can result in contact being made reliably during deliberate short-circuiting.

According to an exemplary embodiment, the flanks of the cones can be angled such that mechanical self-locking occurs once the external cone of the moving contact has entered the internal cone of the fixed contact during switching. The short-circuit that is created in this way therefore remains subsequently, therefore avoiding bouncing, that is to say the contact pieces bouncing apart, where possible.

According to an exemplary embodiment, the short-circuiting device can be arranged within a low-voltage, medium-voltage or high-voltage switchgear assembly comprising one or more switch panels, directly in the feed current path. During a switching process (in the event of a fault), the exemplary short-circuiting device therefore "short-circuits" the phases such that the circuit in parallel with the feed switch closes and any arc which has been created in an outgoer panel is quenched without delay.

According to an exemplary embodiment, the short-circuiting device may comprise only "one three-phase" arrangement or "a plurality of individual" vacuum interrupter chambers. If the individual "plurality of" (i.e., two or more) vacuum interrupter chambers are connected in star (e.g., with three vacuum interrupt chambers), then the star point can be grounded. When grounded, a more complex ground current path is required within a switchgear assembly. The use of vacuum technology ensures constant functionality, irrespective of the current, throughout the entire life.

The drastic reduction in the arcing time, that is to say the considerable reduction in the mechanical and thermal loads within a switchgear assembly in the event of a fault, makes it possible to develop and manufacture cost-effective, compact switch panels and components. According to an exemplary embodiment, the short-circuiting device of the present disclosure can be implemented in air-insulated or gas-insulated low-voltage, medium-voltage or high-voltage switchgear assemblies for "primary and secondary distribution".

FIG. 1 illustrates an exemplary embodiment of a short circuiting device according to the present disclosure.

In FIG. 1, the illustrated short-circuiting device for quenching a fault arc will be described in a closed or open switchgear assembly which short-circuits the three phases (R, Y and B) to one another in the event of a fault. For example, according to an exemplary embodiment, the short-circuiting device can short-circuit the three phases on the basis of a phase short circuit between the phases (R, Y; Y, B) by means of "two" vacuum interrupter chambers or by means of "one" vacuum interrupter chamber. When a fault occurs, in the present case a fault arc, two such vacuum interrupter chambers as illustrated in FIG. 1, for example, close, or the "three-phase" vacuum interrupter chamber, into which the current is therefore commutated from the fault arc, closes. According to an exemplary embodiment, this arrangement can be achieved by the use of a gas generator 1, which may be in the form of, for example, an explosive sleeve which is arranged on one side of a vacuum interrupter chamber and, after being triggered, accelerates the moving contact 7 via the piston 2 in the direction of the fixed contact 8. The gas generator 1 and/or explosive sleeve for causing the moving contact 7 to close on the fixed contact 8 are examples of a unit for causing the moving contact 7 to close onto the fixed contact 8. For a fixed connection of the two conductors after the moving contact 7 and fixed contact 8 have been connected (short-circuited), the two conductor contact pieces (switching (moving) contact piece and fixed contact piece) are designed on the one hand conically and on the other hand in the form of a tulip, such that so-called "self-locking" occurs after connection and the two components remain in the closed state. There is no need to permanently apply any contact force in the connected state.

If the short-circuiting device comprises only "one" vacuum interrupter chamber, this single vacuum interrupter chamber can contain the three conductors of the phases (R, Y and B), corresponding to a star configuration. However, in this arrangement, the star point cannot be grounded. According to an exemplary embodiment, the short-circuiting device is designed such that two conductors are permanently installed in a vacuum interrupter chamber and one conductor is "normal" (at right angles) to the two conductors, and is designed such that it can move. The moving conductor is accelerated by an explosive sleeve (after it explodes) in the direction of the two other conductors, and causes a three-phase short circuit in the device. This vacuum interrupter chamber also contains contact pieces which remain in the connected (short-circuited) position for self-locking after short-circuiting. According to an exemplary embodiment, two vacuum short-circuiting devices can be arranged between the three phases, allowing a short circuit to be produced between the conductors on switching. If the vacuum short-circuiting devices are connected to one another, then two pistons from the central phase, in this case the phase Y, can be initiated with respect to the phases R and B. This exemplary arrangement avoids any reaction force outside the short-circuiting device.

FIG. 1 shows, in detail, that the short-circuiting device is equipped at the top with a piston-cylinder arrangement which moves the moving contact piece 7 during operation, and, underneath, where the fixed contact piece 8 is placed in the vacuum 6, a vacuum chamber is provided, with ceramic insulation 9, that is to say a ceramic wall, for example.

The two areas are separated from one another by a membrane 15. In this case, the membrane can be welded, screwed and/or soldered to the moving contact piece 7, in a vacuum-tight manner. The membrane 15 has a weak breaking line (weak point) 12 which, on operation, is penetrated by the piston 2 itself, or by a cutting edge 13 arranged at the bottom of the piston 2. The cylindrical area 18 is formed in the pressure area, such as in the form of a pressure-resistant cover 3, in which the piston 2 is now accelerated together with the moving supply line 5*a* for the moving contact piece 7 into the vacuum chamber 6. An isolator 9 (e.g., ceramic insulation) provides isolation between the two conductors. During this process, the contact point between the moving contact piece 7 and the fixed contact piece 8 is closed very quickly. The supply-line contact piece of the moving contact 7 has an appropriate conical shape such that, after connection (the closing of the contact pieces), the contact pieces lock securely in the connected position by virtue of the mechanical self-locking. Current is transmitted on the side of the moving contact piece 7 by means of an annular sliding contact on the piston.

The single-phase short-circuiting device-vacuum interrupter chamber (VK) 9 6 can be switched between the three conductors R, Y; and Y; B. It is also possible to provide a vacuum interrupter chamber 9 6 for each phase. In this exemplary configuration, the resultant star point can be designed to switch open or else be grounded. The vacuum interrupter chamber 9 6 has a moving supply line 5 in addition to a fixed soldered-in supply line with a contact area 8. The ceramic isolator 9 provides the isolation between the two conductors 7, 8. A piston 2, which can be designed as illustrated in the exemplary embodiment of FIG. 1, is can be located outside the vacuum and above the membrane 15 on the moving supply line 5 with a conical contact area 7. A gas generator 1, for example in the form of an explosive charge, is located above the piston 2 and, for as long as it the gas generator is not operated, keeps the piston 2 locked in the upper position, so that the contact pieces 7, 8 are kept apart in the vacuum 6. A further possible way to hold. According to an exemplary embodiment, the piston 2 in this position can be provided by a wire or else a rod between the piston 2 and the cover 3. In the event of a fault, the explosive charge 1 is caused to explode after detection (line sensor+electronics evaluation unit+initiation trigger output) and initiation. In the pressure area, which in this case is can be in the form of a pressure-resistant cover 3, the piston 2 is accelerated into the vacuum interrupter chamber 6, together with the moving supply line. During the switching process, the contact point is closed very rapidly. The supply-line contact piece 7 has a corresponding conical shape so that, after connection (the closing of the contact pieces), the contact pieces are securely locked in the connected position by virtue of the mechanical self-locking. As illustrated herein the exemplary embodiment of FIG. 1, vacuum sealing can be achieved by means of bellows. The current transmission on the moving side can be achieved by a multicontact sliding system, or else via a current band solution, for example.

Figure 2:
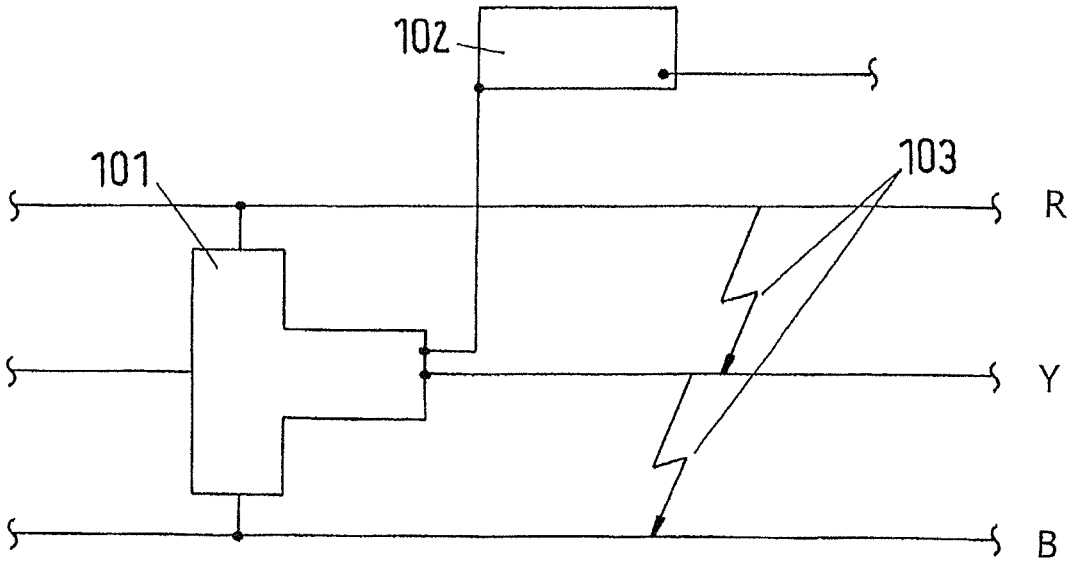
FIG. 2 shows an exemplary polyphase configuration in a three-phase power supply system according to an embodiment of the present disclosure.

FIG. 2 shows a cyclic diagram with the three phases R; Y; B according to an exemplary embodiment. For protection purposes, a short-circuiting device such as the device illustrated in FIG. 1 is located in the area of the three phases of the short-circuiting device, which has "three phases", and which is connected to the three phases. If a fault arc (103) occurs between the phases or to ground, the arc is detected, for example optically (e.g., by optical sensor means), and the explosive capsule or the gas generator in the vacuum interrupter chamber (101) is caused to explode via the control unit (102). Once the contact pieces have closed, the current is commutated into the vacuum interrupter chamber (101), and the fault arc (103) is quenched. According to an exemplary embodiment, the control unit may be a computer processing device (e.g., CPU) having a processor configured to execute computer-readable instructions recorded on a computer-readable recording medium, such as a ROM, hard disk drive or other suitable non-volatile memory.

Figure 3:
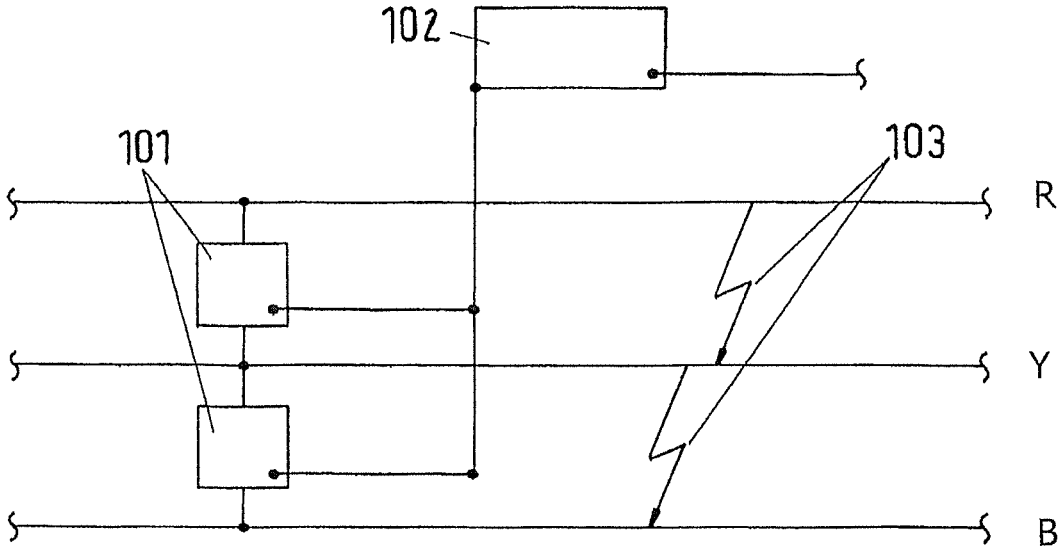
FIG. 3 shows an exemplary single-phase configuration in a three-phase power supply system according to an embodiment of the present disclosure.

FIG. 3 shows a circuit diagram with the three phases R; Y; B according to an exemplary embodiment. For protection purposes, a "single-phase" short-circuiting device is located between the three phases, is designed according to the exemplary embodiment shown in FIG. 1, and is connected to the phases (R, Y; Y, B). If a fault arc (103) occurs between the phases or to ground, the arc is detected, for example optically (e.g., by an optical sensor), and the explosive capsule in the vacuum interrupter chamber (101) is caused to explode via the control unit (102). Once the contact pieces have closed, the current is commutated into the vacuum interrupter chamber (101), and the fault arc (103) is quenched.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE SYMBOLS

1 Gas generator, explosive capsule (excitation unit)
2 Piston
3 Cover
5 Supply line
6 Vacuum
7 Moving contact
8 Fixed contact
9 Isolator
10 Connection to the fixed contact
11 Sliding contact
12 Weak breaking line
13 Cutting edge
14 Screw connection
15 Membrane
16 Housing
17 Circumferential groove
18 Cylinder
101 Vacuum interrupter chamber
102 Control unit
103 Fault arc

What is claimed is:

1. A switchgear assembly comprising:
a vacuum interrupt chamber; and
at least one short-circuiting device arranged in the vacuum interrupt chamber, the at least one short-circuiting device including:
a fixed contact piece arranged in a vacuum area of the vacuum interrupter chamber;
a moving contact piece;
a unit for causing the moving contact piece to close onto the fixed contact piece;
a membrane sub-dividing the vacuum area in which the fixed contact piece is arranged, the membrane having a breaking line which is configured to be penetrated during a switching operation when the moving contact piece is moved through the membrane and closed onto the fixed contact piece; and
a piston-cylinder arrangement connected to the moving contact piece, the piston-cylinder arrangement having an electrically conductive piston arranged on a running surface of the moving contact piece and makes an electrically conductive connection with the moving contact, the piston at least partially surrounding the moving contact piece along a lengthwise axis, being configured to be acted on by the unit for causing the moving contact piece to come into contact with the fixed contact piece, and having a cutting edge on a lower face of the piston in proximity to the breaking line of the membrane, wherein the cutting edge is configured to pass through the breaking line of the membrane during operation.

2. The switchgear assembly as claimed in claim 1, wherein the moving contact piece comprises a moving contact arranged at a tip of the moving contact piece, and
wherein, when the moving contact piece is an unoperated state of the moving contact is configured to pass through the membrane to form a vacuum-tight seal.

3. The switchgear assembly as claimed in claim 1, wherein the moving contact piece is at least one of welded, screwed and soldered to the membrane.

4. The switchgear assembly as claimed in claim 1,
wherein the switchgear assembly comprises an annular sliding contact arranged on the piston running surface.

5. The switchgear assembly as claimed in claim 1, wherein the unit for causing the moving contact piece to close onto the fixed contact piece is a gas generator is in the form of a cartridge with a chemical propellant charge which is insertable and securable via a screw connection fitted at an appropriate point to a housing of the vacuum interrupt chamber.

6. The switchgear assembly as claimed in claim 1, wherein an upper part of the short-circuiting device comprises the piston-cylinder arrangement, which is composed of metallic material, and a lower part of the short-circuiting device comprises a vacuum interrupter chamber which is composed of an insulator.

7. The switchgear assembly as claimed in claim 6, wherein at least one of the vacuum interrupter chamber and a dielectric material of the vacuum interrupt chamber is composed of a ceramic material.

8. The switchgear assembly as claimed in claim 2, wherein the tip of the moving contact is provided with an external cone, and the fixed contact is provided with an internal cone which is complementary to the external cone of the moving contact.

9. The switchgear assembly as claimed in claim 8, wherein flanks of the external and internal cones are angled to achieve mechanical self-locking once the external cone has entered the internal cone during switching.

10. The switchgear assembly as claimed in claim 2, wherein the moving contact piece is at least one of welded, screwed and soldered to the membrane.

11. The switchgear assembly as claimed in claim 1, wherein the unit for causing the moving contact piece to be closed onto the fixed contact piece is one of a gas generator and an explosive capsule.

12. The switchgear assembly as claimed in claim 2, wherein the unit for causing the moving contact piece to be closed onto the fixed contact piece is one of a gas generator and an explosive capsule.

13. The switchgear assembly as claimed in claim 3, wherein the unit for causing the moving contact piece to be closed onto the fixed contact piece is one of a gas generator and an explosive capsule.

14. The switchgear assembly as claimed in claim 1, wherein an upper part of the short-circuiting device comprises the piston-cylinder arrangement which is composed of metallic material and which is connected to the moving contact piece to drive the moving contact piece toward the fixed contact piece, and a lower part of the short-circuiting device comprises a vacuum interrupter chamber which is composed of an insulator.

15. The switchgear assembly as claimed in claim 1, wherein the short-circuiting device is configured to be operated in at least one of a low-voltage, medium-voltage and high-voltage switchgear assembly.

* * * * *